US011753841B2

(12) United States Patent
Zhang et al.

(10) Patent No.: US 11,753,841 B2
(45) Date of Patent: Sep. 12, 2023

(54) HYDRODYNAMIC WATER BLOCKING DEVICE FOR UNDERGROUND GARAGE AND METHOD

(71) Applicant: QINGDAO UNIVERSITY OF TECHNOLOGY, Shandong (CN)

(72) Inventors: Yanbin Zhang, Qingdao (CN); Yuji Li, Qingdao (CN); Long Wei, Qingdao (CN); Fenglei Zhu, Qingdao (CN); Haochen Sun, Qingdao (CN); Biao Cao, Qingdao (CN); Changhe Li, Qingdao (CN); Xin Cui, Qingdao (CN); Min Yang, Qingdao (CN); Yuying Yang, Qingdao (CN); Xufeng Zhao, Qingdao (CN); Xiaoming Wang, Qingdao (CN); Teng Gao, Qingdao (CN); Mingzheng Liu, Qingdao (CN)

(73) Assignee: QINGDAO UNIVERSITY OF TECHNOLOGY, Shandong (CN)

( * ) Notice: Subject to any disclaimer, the term of this patent is extended or adjusted under 35 U.S.C. 154(b) by 127 days.

(21) Appl. No.: 17/480,729

(22) Filed: Sep. 21, 2021

(65) Prior Publication Data

US 2022/0268047 A1 Aug. 25, 2022

(30) Foreign Application Priority Data

Feb. 25, 2021 (CN) ..... 202110210753.5

(51) Int. Cl.
*E05F 1/00* (2006.01)
*E04H 6/42* (2006.01)
(Continued)

(52) U.S. Cl.
CPC ..... *E04H 6/42* (2013.01); *E05F 15/627* (2015.01); *E05F 15/72* (2015.01); *E06B 5/10* (2013.01);
(Continued)

(58) Field of Classification Search
CPC ..... E04H 6/45; E04H 9/145; E05F 15/627; E05F 15/72; E06B 5/10; E06B 2009/007;
(Continued)

(56) References Cited

U.S. PATENT DOCUMENTS 6,514,011 B2 * 2/2003 Nomura ..... F15B 15/16 405/102
6,623,209 B1 * 9/2003 Waters, Jr. ..... E02B 7/44 405/100
(Continued)

FOREIGN PATENT DOCUMENTS

CN 109505502 A 3/2019
CN 111636802 A 9/2020
(Continued)

*Primary Examiner* — Jerry E Redman
(74) *Attorney, Agent, or Firm* — Oliff PLC

(57) ABSTRACT

A hydrodynamic water blocking device for an underground garage includes a water blocking plate assembly and side rail assemblies, wherein the water blocking plate assembly includes a first water blocking element, one end of the first water blocking element is rotationally connected with a base, the other end of the first water blocking element is rotationally connected with one end of a second water blocking element, the first and second water blocking elements have foamed layers, the base has grooves capable of accommodating the embedded foamed layers, water inlets formed in the base communicate with the grooves, each of the side rail assemblies includes a side plate with an ascending rail including a horizontally disposed linear rail and an arc-shaped lifting rail, the second water blocking element has a walking assembly embedded in the ascending rail which is connected with a driving mechanism installed at the second water blocking element.

18 Claims, 18 Drawing Sheets

(51) Int. Cl.
*E05F 15/627* (2015.01)
*E05F 15/72* (2015.01)
*E06B 5/10* (2006.01)

(52) U.S. Cl.
CPC ... *E05Y 2201/434* (2013.01); *E05Y 2201/652* (2013.01); *E05Y 2201/684* (2013.01); *E05Y 2400/40* (2013.01); *E05Y 2400/44* (2013.01); *E05Y 2400/52* (2013.01); *E05Y 2400/616* (2013.01); *E05Y 2900/106* (2013.01)

(58) Field of Classification Search
CPC ..... E06B 9/04; E05Y 2201/434; E05Y 2201/652; E05Y 2201/684; E05Y 2400/40; E05Y 2400/44; E05Y 2400/52; E05Y 2400/616; E05Y 2900/106; E02B 3/16; E02B 3/104; E01F 13/08
USPC ..... 49/131, 132, 133, 134
See application file for complete search history.

(56) References Cited

U.S. PATENT DOCUMENTS 8,511,939 B2 * 8/2013 Waters, Jr. ..... E02B 7/50 405/15
8,590,560 B2 * 11/2013 Komatsu ..... E03F 9/007 405/95
8,714,875 B2 * 5/2014 Morii ..... E02B 7/50 405/28
9,011,042 B2 * 4/2015 Nakayasu ..... E02B 3/102 405/99
9,267,322 B2 * 2/2016 Inui ..... E06B 9/04
9,458,588 B2 * 10/2016 Waters, Jr. ..... E02B 3/104
10,619,317 B2 * 4/2020 Waters, Jr. ..... E02B 3/102
10,619,318 B1 * 4/2020 Waters, Jr. ..... E02B 7/54
11,447,996 B2 * 9/2022 Park ..... E03F 5/101
2004/0009041 A1 * 1/2004 Aughton ..... G05D 7/067 405/87
2012/0219360 A1 * 8/2012 Morii ..... E02B 7/44 405/100
2014/0193202 A1 * 7/2014 Arai ..... E02B 7/40 405/100
2016/0010298 A1 * 1/2016 Waters, Jr. ..... E02B 7/205 405/102

FOREIGN PATENT DOCUMENTS

CN 112982284 A * 6/2021 ..... E01F 13/08
CN 115075187 A * 9/2022
CN 115126315 A * 9/2022
GB 2451843 A * 2/2009 ..... E02B 3/104
GB 2529648 A * 3/2016 ..... E02B 3/104
WO WO-2017133680 A1 * 8/2017 ..... E02B 3/10

* cited by examiner

HYDRODYNAMIC WATER BLOCKING DEVICE FOR UNDERGROUND GARAGE AND METHOD

BACKGROUND

Technical Field

The present invention relates to the technical field of water blocking for underground building, and more particularly relates to a hydrodynamic water blocking device for an underground garage and a method.

Related Art

Descriptions herein only provide background techniques related to the present invention, and do not necessarily constitute the related art.

When typhoon and storms come, an urban drainage system is overloaded, and rainwater rushes into an underground garage of a residential district, so that a large number of vehicles are soaked in water, and property loss is caused.

At present, a building or a residence in a lower area can be flooded when meeting heavy rain, so that a resident usually stacks sand bags or nails water blocking plates at an entrance of the building and the residence to prevent external water from entering rooms. The inventor discovered that these methods such as sand bag stacking have defects of labor waste and time waste, and the carrying is laborious when sand bags are carried away when being not used. Additionally, the effect of water blocking plate nailing is poor, nail marks will be left when the nailed water blocking plates are dismounted when being useless, and the appearance of the entrance will be influenced. Additionally, there will be great problems when the water blocking plates or sand bags are used. At the early water blocking stage, vehicles cannot go into or out of the garage, disputes may be generated between a property management company and owners, the property management company needs to block, but vehicle owners want to go into or out of the garage. By using a manual method to block water, the response cannot be timely and effectively made at night, the garage also has the flooding risk, it is difficult to cope with sudden flood conditions, and collapse and water leakage easily occur.

Through search, Shi Weiwu and Wang Weicheng invented a composition structure of a movable waterproof gate (patent number: 201710840776.8). This invention provides a composition structure of a movable type waterproof gate consisting of a frame seat, a main gate plate, a plurality of laminated gate plates, a plurality of buckling and pressing switches and a plurality of clamps through relative configuration. In order to prevent external water from flooding into rooms, the formed gate of this invention can be fast assembled to fast block water when meeting heavy rain. Additionally, through the longitudinally laminated buckling and hooking structures of each layer of laminated gate plates, the plurality of laminated gate plates can be erected to a preset height through freely upward laminated buckling and hooking, and the quantity of the laminated gate plates and clamps can be increased or decreased at any time according to conditions. The water blocking effect can be simply enhanced and stabilized, and moreover, water blocking height adjustment convenience and function can be achieved. However, this invention needs manual installation in the use process, and the laminated gate plates need to be controlled to be erected to a required height by manually monitoring the real-time change of the water level. Although this method can be used for blocking certain water and preventing an underground garage from being blooded, the defect that labor is needed cannot be overcome, and full automation is not achieved.

Through search, Duan Ruiyong, Yan Jiling, Zhang Wenjun, Qiu Rui, Huang Long and Li Juguang invented an underground garage front end inflation waterproof device (patent number: 202010534735.8) which is disposed on an underground garage entrance slope and includes an air bag, a turning plate and hydraulic cylinders. An air bag groove is formed in the slope, two ends of the air bag grooves extend into wall bodies at two sides of the slope, and extend towards the upper sides of the wall bodies to form air bag sealing grooves, the air bag is installed at the bottom surface of the air bag groove, two ends of the air bag are vertically provided with guide posts, the turning plate is rotatably installed at the top surface of the air bag groove, the hydraulic cylinders are disposed at two ends of the turning plate, the hydraulic cylinders are connected with a hydraulic pump, and the air bag is connected with an air compressor. A pressure sensor is disposed on the wall body of the air bag sealing groove, a plurality of water level sensors are disposed near the wall bodies at two sides or in the garage, and the hydraulic pump and the air compressor are controlled to work according to detection signals of the pressure sensor and the water level sensors. However, according to the method, once the air bag works to block water, the goal that vehicles freely go into or out of the garage at the early water blocking stage (under the condition that the water level is not very high) cannot be achieved, and great inconvenience is brought to the practical application.

SUMMARY

An objective of the present invention is to overcome the defects in the prior art, and provide a hydrodynamic water blocking device for an underground garage, the use is convenient, and the access of vehicles cannot be influenced at an early water blocking stage.

In order to achieve the above objective, the present invention adopts the technical scheme as follows:

In a first aspect, the present invention provides a hydrodynamic water blocking device for an underground garage, including a water blocking plate assembly and side rail assemblies, wherein the water blocking plate assembly includes a first water blocking element, one end of the first water blocking element is rotationally connected with a base, the other end of the first water blocking element is rotationally connected with one end of a second water blocking element, the first water blocking element and the second water blocking element are provided with foamed layers, the base is provided with grooves capable of accommodating the embedded foamed layers, water inlets formed in the base communicate with the grooves, each of the side rail assemblies includes a side plate, the side plate is provided with an ascending rail, the ascending rail includes a horizontally disposed linear rail and an arc-shaped lifting rail, the second water blocking element is provided with a walking assembly embedded in the ascending rail, and the walking assembly is connected with a driving mechanism installed at the second water blocking element.

Further, each of the first water blocking element and the second water blocking element is provided with a power generating assembly mounted thereon, the power generating assembly is connected with an energy storage power supply, and the energy storage power supply is connected with the driving mechanism, and is configured to supply electricity to the driving mechanism.

Further, each of the first water blocking element and the second water blocking element includes an upper load bearing protection plate with a cavity formed at the inside, a lower load bearing plate is fixed inside the upper load bearing protection plate, the power generating assembly includes press strips, a middle portion of the press strip is fixed to the lower load bearing plate, an end portion tightly presses the upper load bearing protection plate through a press strip elastic element, the lower load bearing plate is further fixedly connected with one end of a plurality of piezoelectric patches, the other end of the piezoelectric patches is connected with the lower load bearing plate through piezoelectric patch elastic elements, and a piezoelectric patch padding plate is disposed between the piezoelectric patches and the lower load bearing plate.

Further, the foamed layers are polyurethane foamed layers, and the polyurethane foamed layers are fixed onto bottom surfaces of the first water blocking element and the second water blocking element through polyurethane foamed layer fixing sheets.

Further, each of the first water blocking element and the second water blocking element includes a plurality of water blocking unit modules, and the adjacent water blocking unit modules are connected through connecting elements.

Further, the first water blocking element is hinged to one end of a first connecting rod, the other end of the first connecting rod is hinged to a hinging element, the hinging element is hinged to one end of a second connecting rod, and the other end of the second connecting rod is hinged to the base.

Further, the driving mechanism includes a driving element fixed to a top end of the second water blocking element, the driving element is connected with a transmission shaft through a transmission mechanism, the transmission shaft is connected with the walking assembly, the walking assembly includes a belt wheel and a rolling wheel, the rolling wheel and the belt wheel are embedded in the ascending rail, and the belt wheel is able to be in contact with a synchronous belt disposed in the lifting rail.

Further, a position limiting switch is disposed at one side of the linear rail, and the position limiting switch is able to be in contact with the walking assembly.

Further, a liquid level sensor is disposed on the side plate, and is configured to detect a water level height of rainwater.

In a second aspect, the present invention provides a working method of the hydrodynamic water blocking device for an underground garage. The grooves formed in the base receive rainwater flowing in from the water inlets, buoyancy is generated on the first water blocking element and the second water blocking element through the foamed layers, the rolling wheel moves along the linear rail, the top end of the first water blocking element and the bottom end of the second water blocking element are lifted to achieve a water blocking effect, after the water level reaches a set alert height, the driving mechanism drives the walking assembly to work, the walking assembly enters the lifting rail through the linear rail and then ascends along the lifting rail, and the top end of the second water blocking element is lifted.

The present invention has the following beneficial effects:

1. The water blocking device of the present invention can utilize buoyancy of rainwater and the driving mechanism to drive the walking assembly to move along the ascending rail, so that the first water blocking element and the second water blocking element are lifted to achieve a water blocking effect, automatic working is achieved, sand bag stacking or water blocking plate nailing is not needed, the use is convenient, and the time and the labor are saved.

2. By using the water blocking device of the present invention, when the rainwater quantity is small, the walking assembly moves in the linear rail, the lifting height of the first water blocking element and the second water blocking element can be lower than the height of a vehicle chassis, and an effect of preventing rainwater from entering the underground garage can be achieved without affecting the normal passing of vehicles.

3. The water blocking device of the present invention is provided with the power generating assembly, the energy storage power supply can be charged by using the power generating assembly, additional connection of a power supply is not needed, and the use is convenient.

BRIEF DESCRIPTION OF THE DRAWINGS

The accompanying drawings constituting a part of this application are used for providing further understanding for this application. Exemplary embodiments of this application and descriptions thereof are used for explaining this application and do not constitute a limitation to this application.

Figure 1:
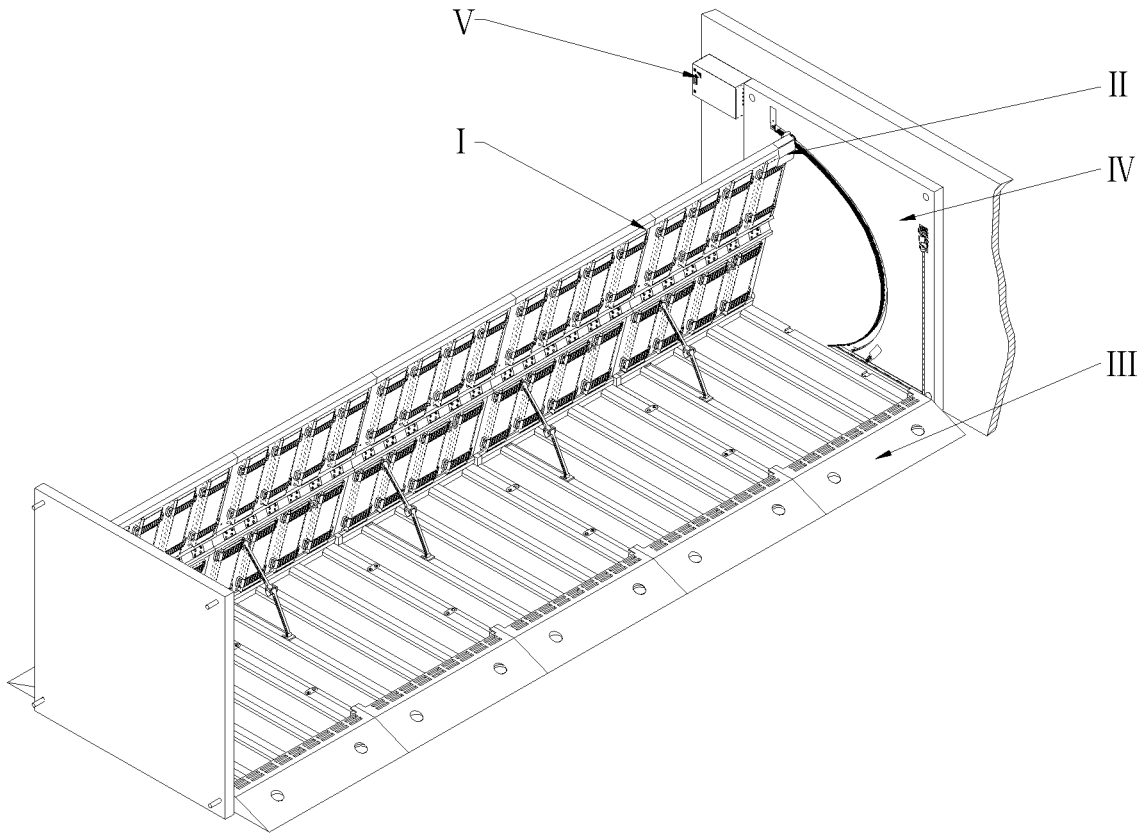
FIG. 1 is a schematic diagram of an integral structure of Embodiment 1 of the present invention.
Figure 2:
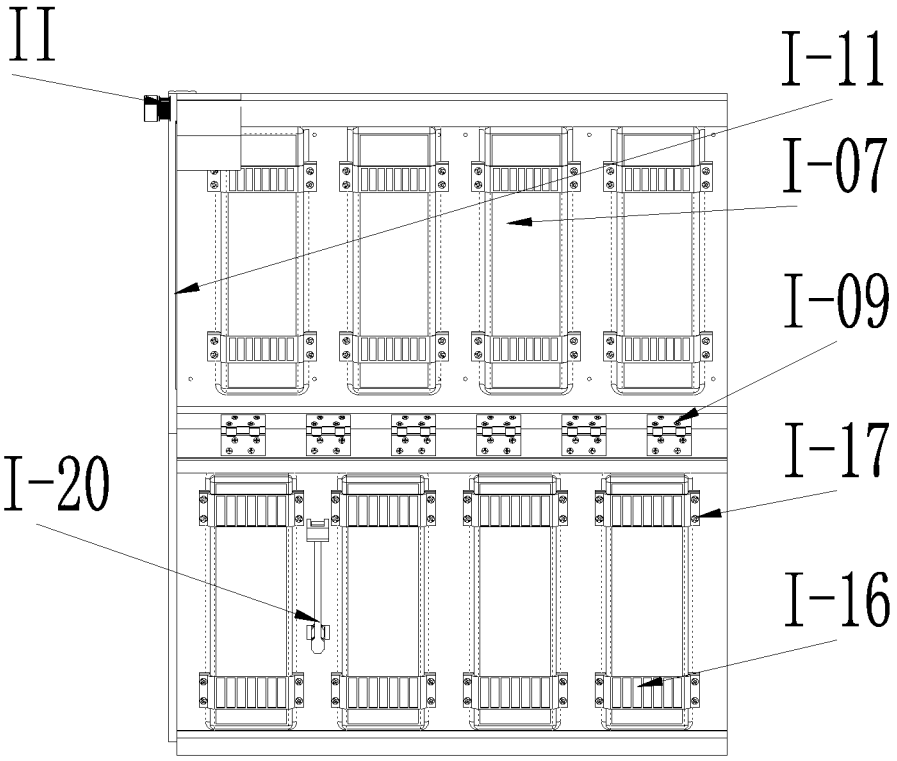
FIG. 2 is a bottom view of a water blocking plate assembly of Embodiment 1 of the present invention.
Figure 3:
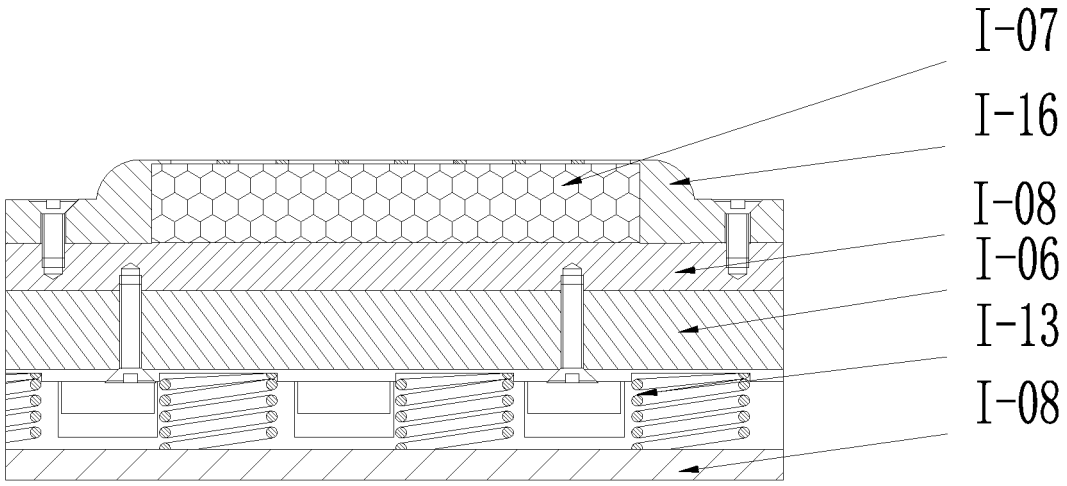
FIG. 3 is a sectional view of the water blocking plate assembly of Embodiment 1 of the present invention.
Figure 4:
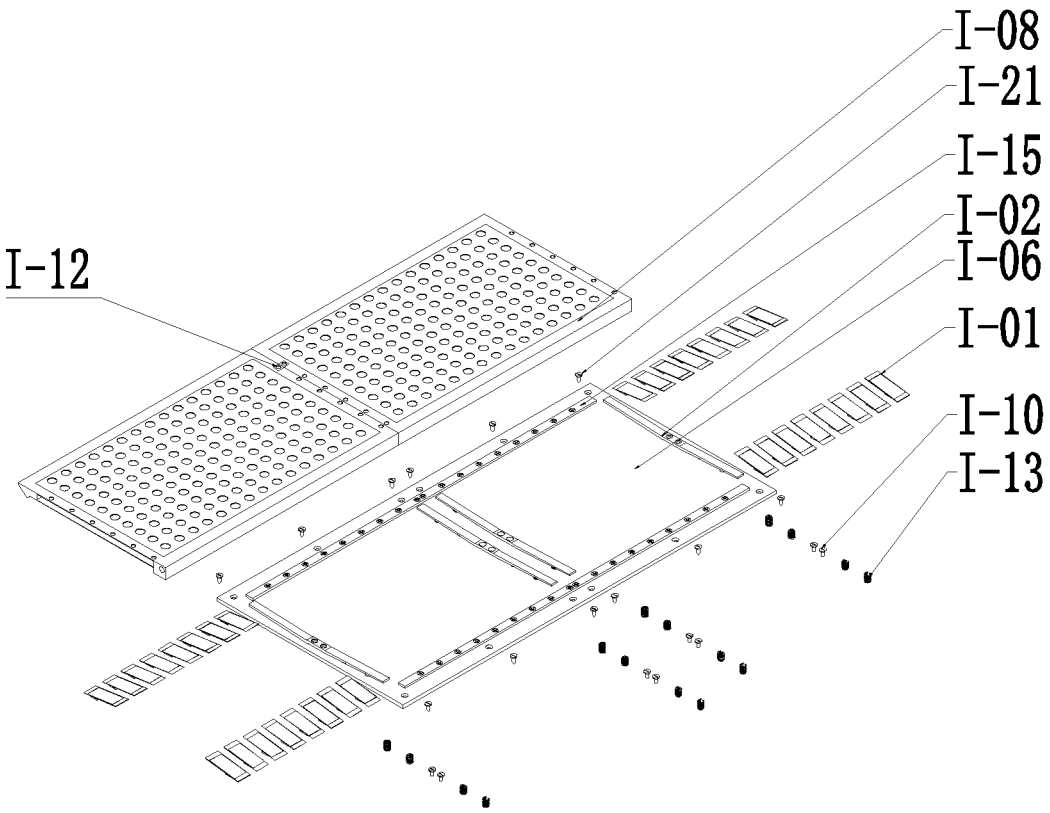
FIG. 4 is an exploded schematic diagram of the water blocking plate assembly of Embodiment 1 of the present invention.
Figure 5:
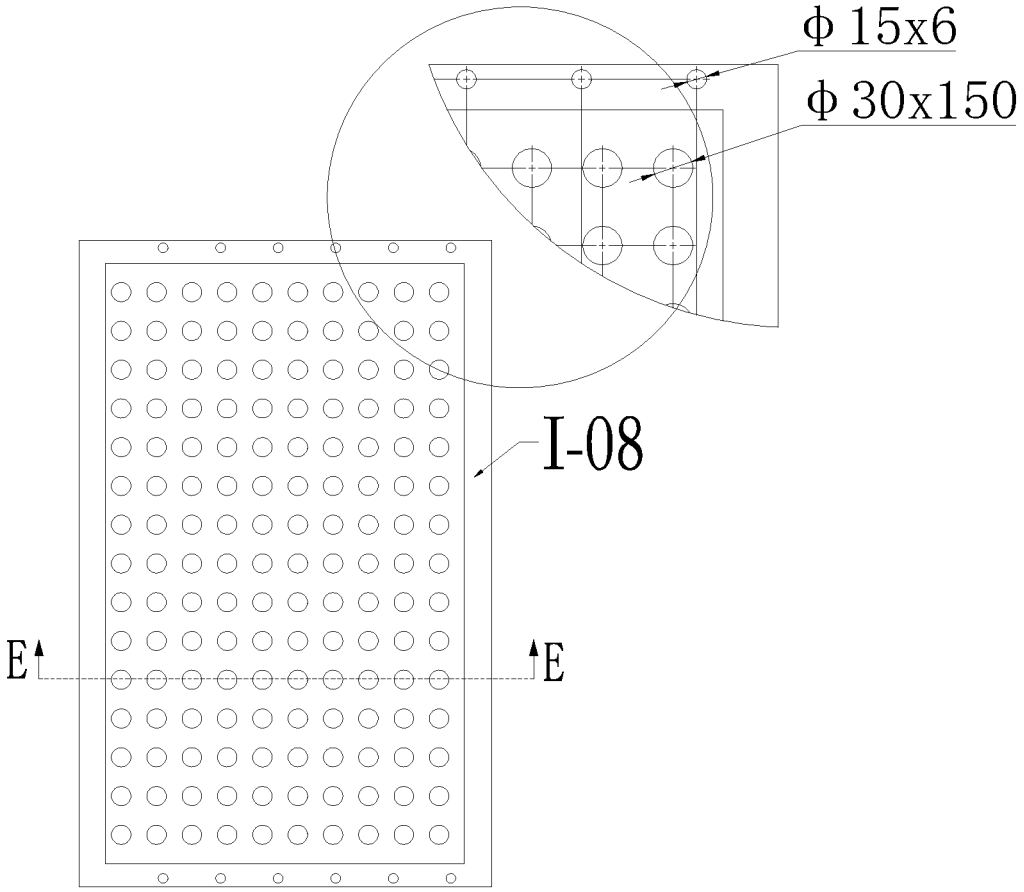
FIG. 5 is a top view of a first water blocking plate of Embodiment 1 of the present invention.
Figure 6:
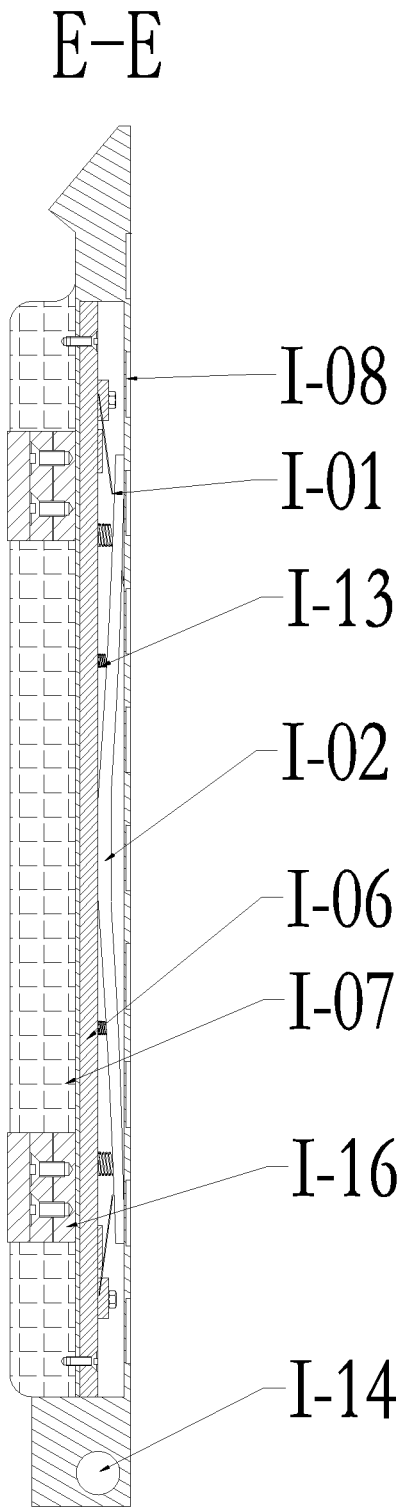
FIG. 6 is a schematic diagram of an E direction cross section in FIG. 5 of the present invention.
Figure 7:
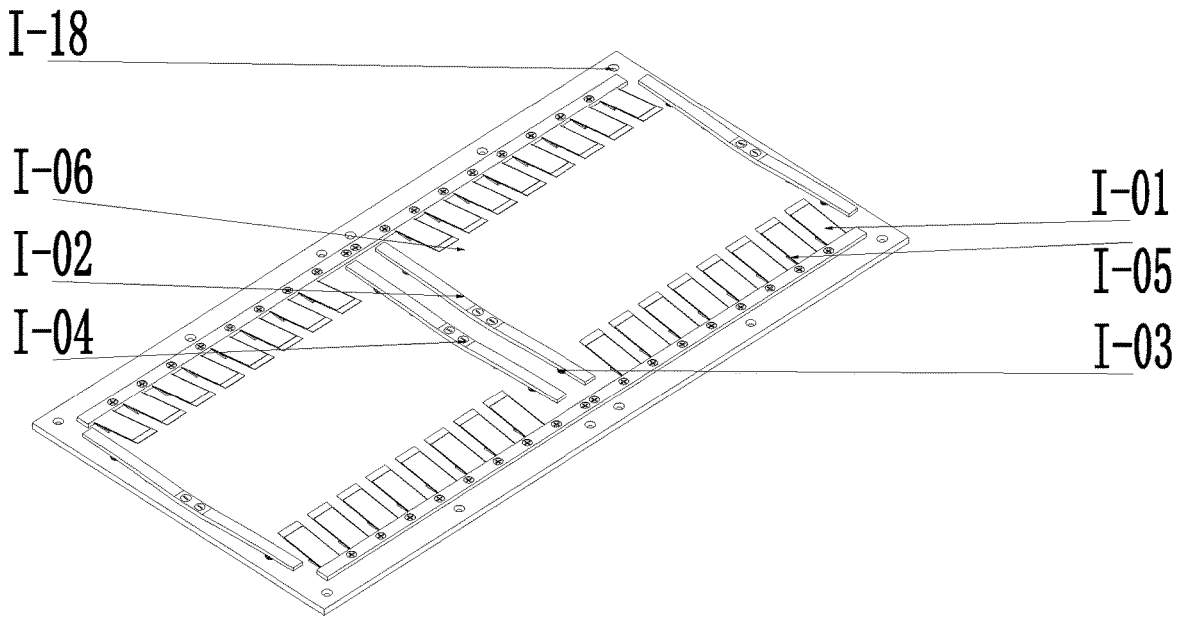
FIG. 7 is a schematic diagram of a power generating assembly of Embodiment 1 of the present invention.
Figure 8:
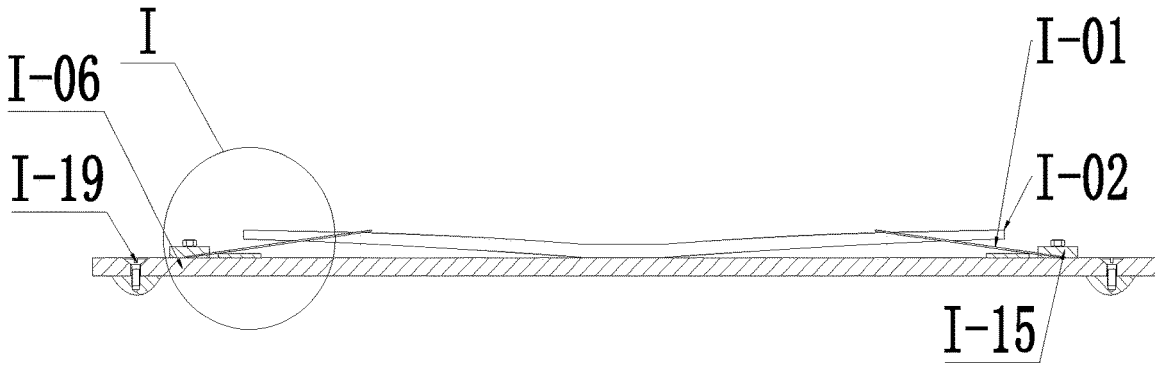
FIG. 8 is a sectional view of the power generating assembly of Embodiment 1 of the present invention.
Figure 9:
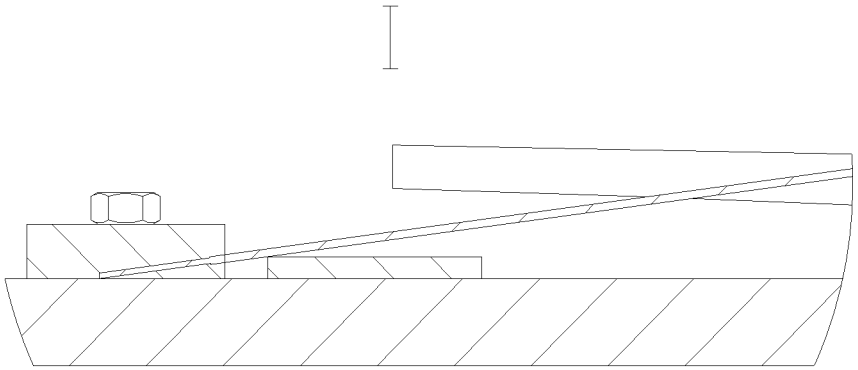
FIG. 9 is an enlarged view of a position I of FIG. 8 of the present invention.
Figure 10:
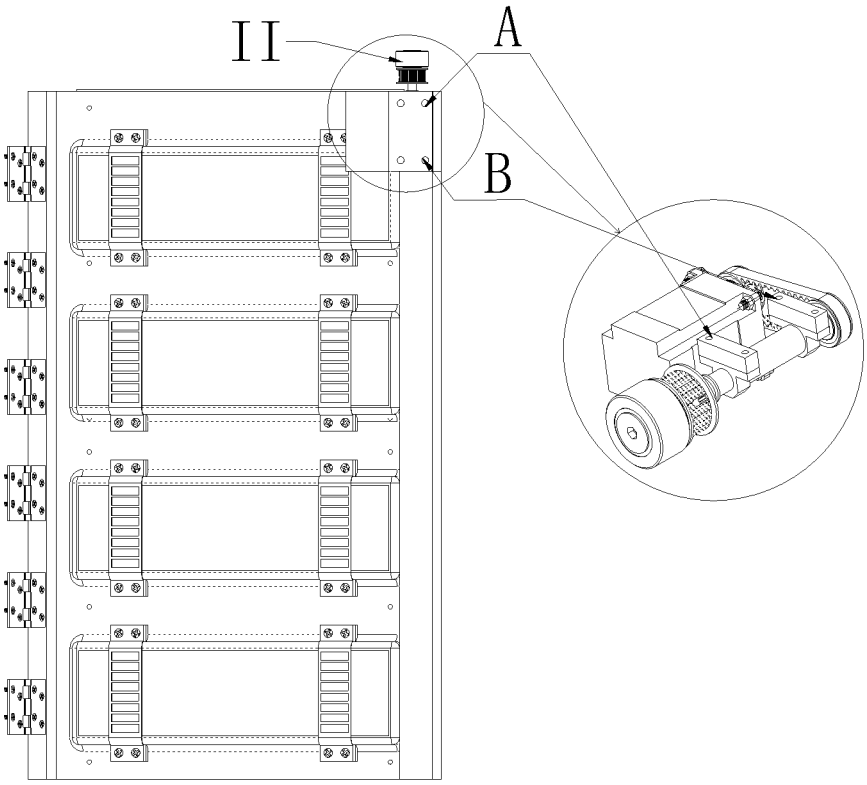
FIG. 10 is a bottom view of a second water blocking element of Embodiment 1 of the present invention.
Figure 11:
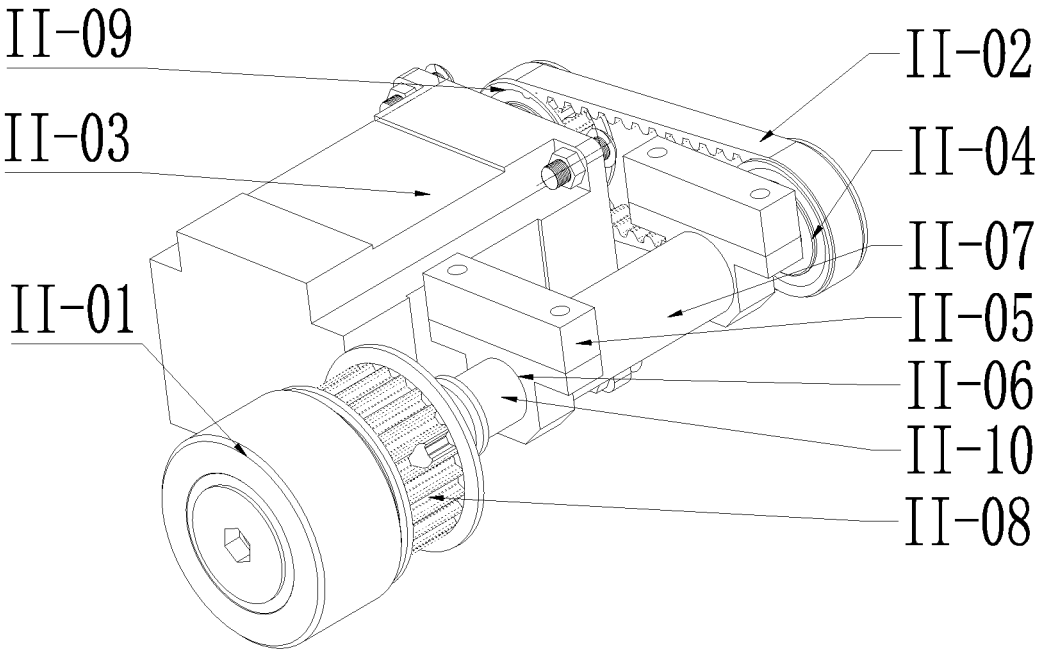
FIG. 11 is a schematic diagram for assembling a driving mechanism and a walking assembly of Embodiment 1 of the present invention.
Figure 12:
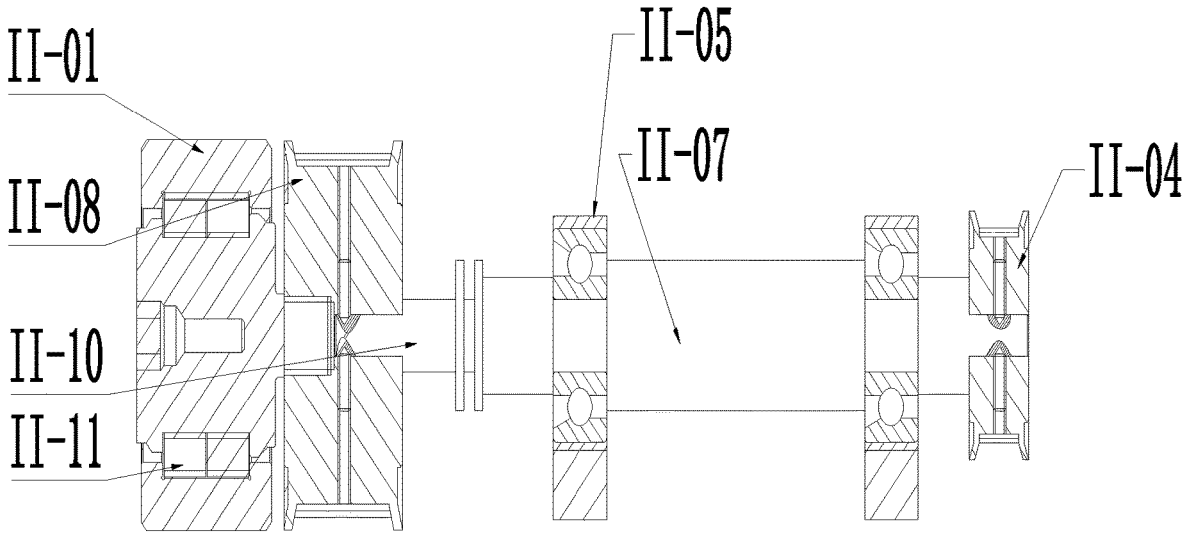
FIG. 12 is a sectional view for assembling the driving mechanism and the walking assembly of Embodiment 1 of the present invention.
Figure 13:
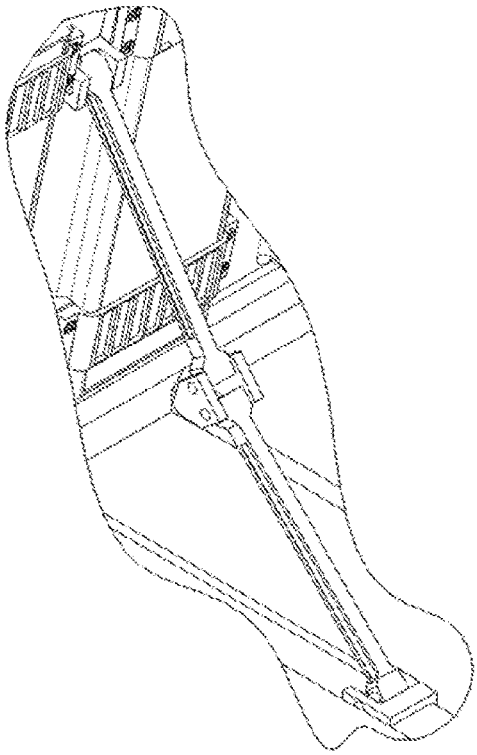
FIG. 13 is a schematic diagram for assembling a first connecting rod and a second connecting rod of Embodiment 1 of the present invention.
Figure 14:
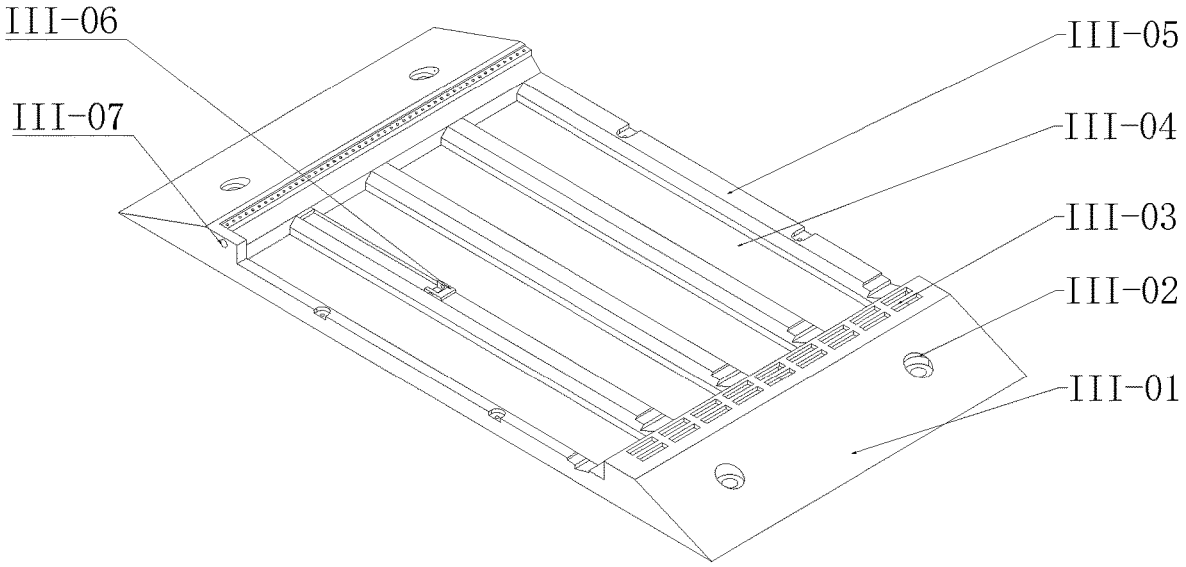
FIG. 14 is a schematic structure diagram of a base of Embodiment 1 of the present invention.
Figure 15:
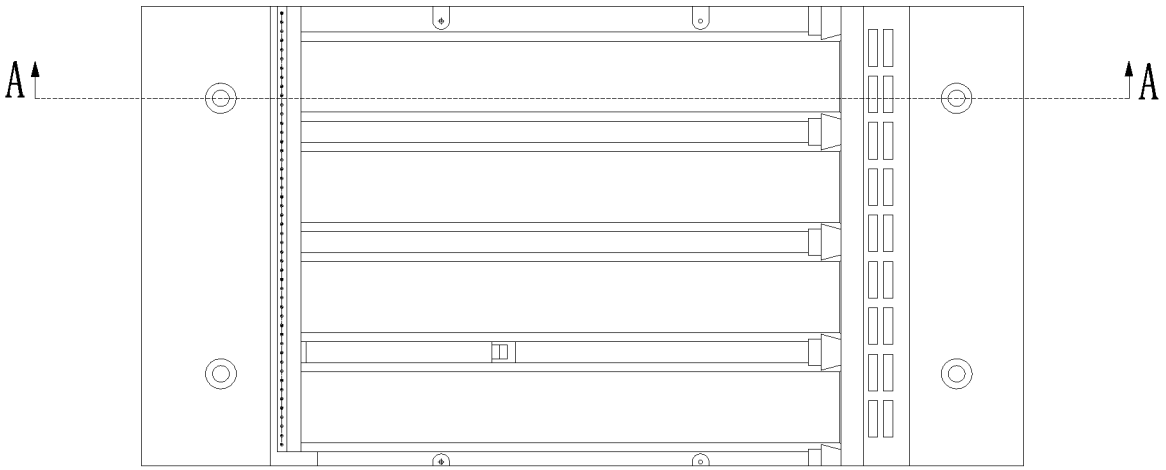
FIG. 15 is a top view of the base of Embodiment 1 of the present invention.
Figure 16:
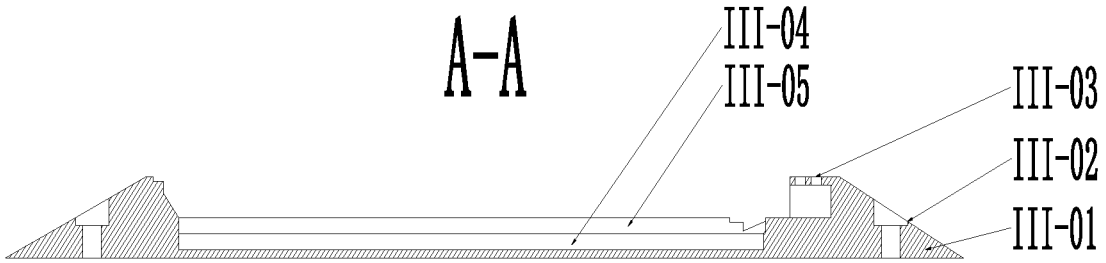
FIG. 16 is a schematic diagram of an A direction cross section of FIG. 15 of the present invention.
Figure 17:
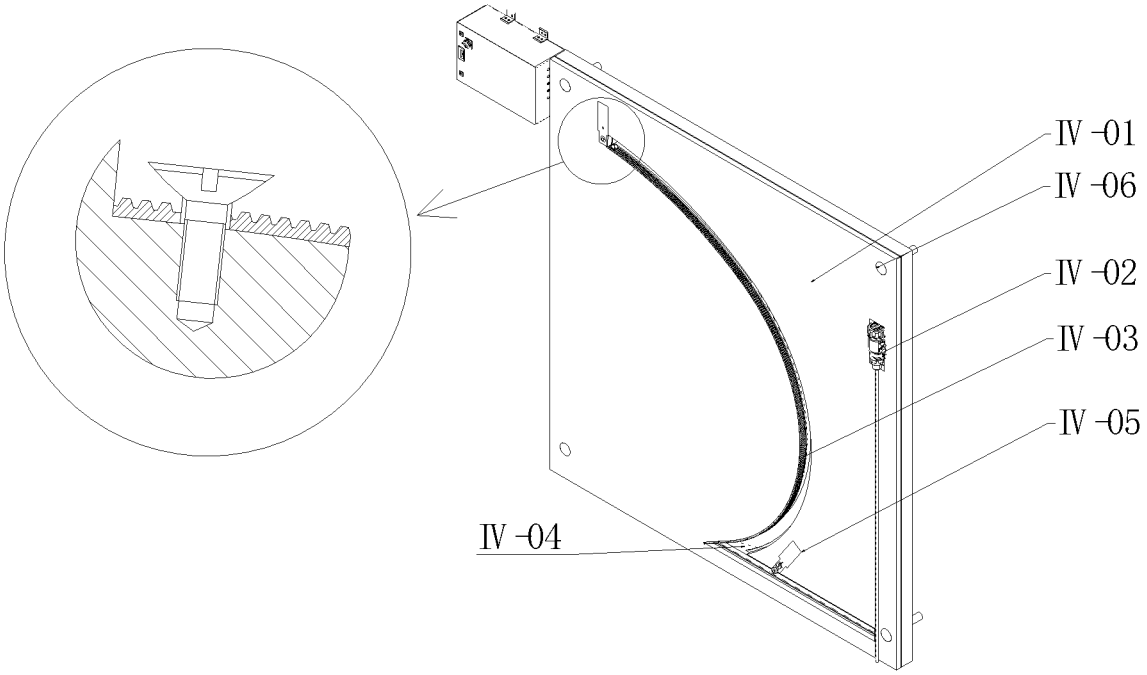
FIG. 17 is a schematic structure diagram of a side rail assembly of Embodiment 1 of the present invention.
Figure 18:
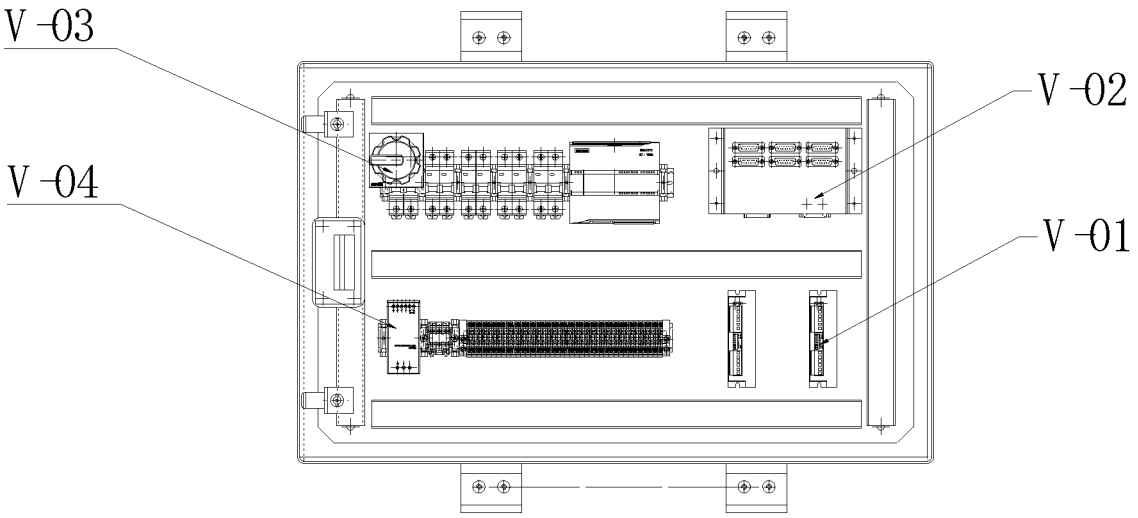
FIG. 18 is a schematic structure diagram of a device control box of Embodiment 1 of the present invention.
Figure 19:
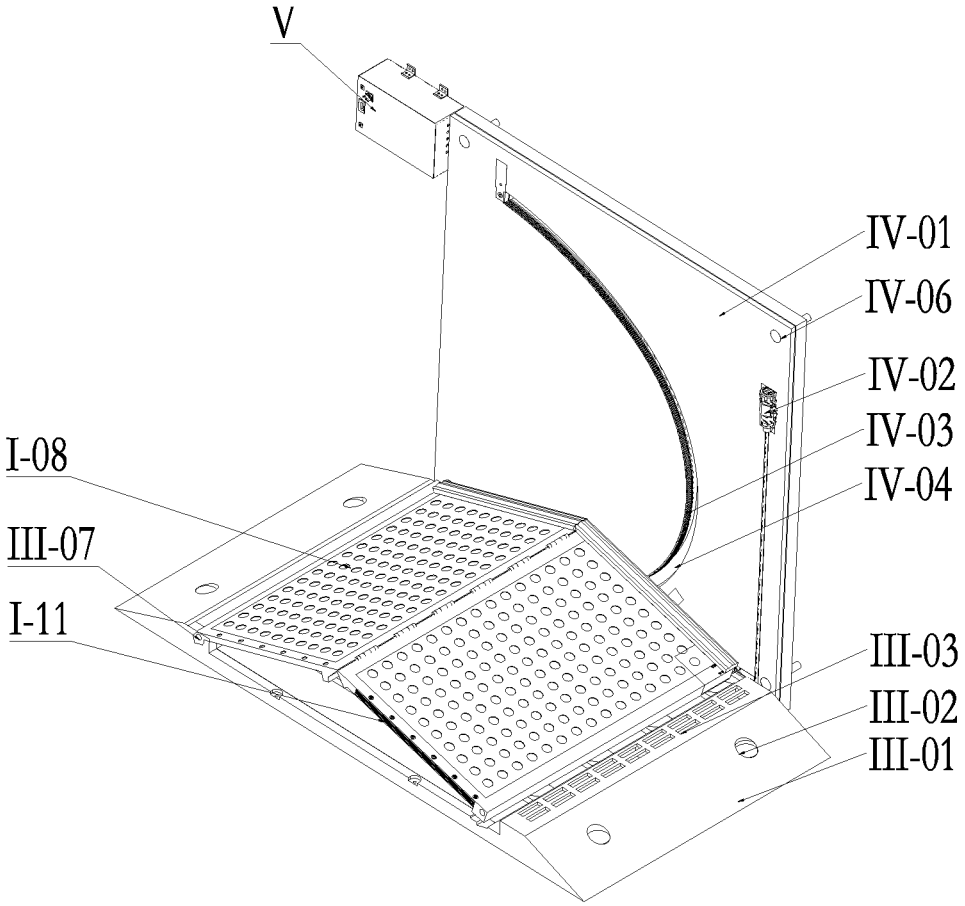
FIG. 19 is a schematic diagram of a first water blocking element and a second water blocking element of Embodiment 2 of the present invention in reverse V-shaped structure distribution.
Figure 20:
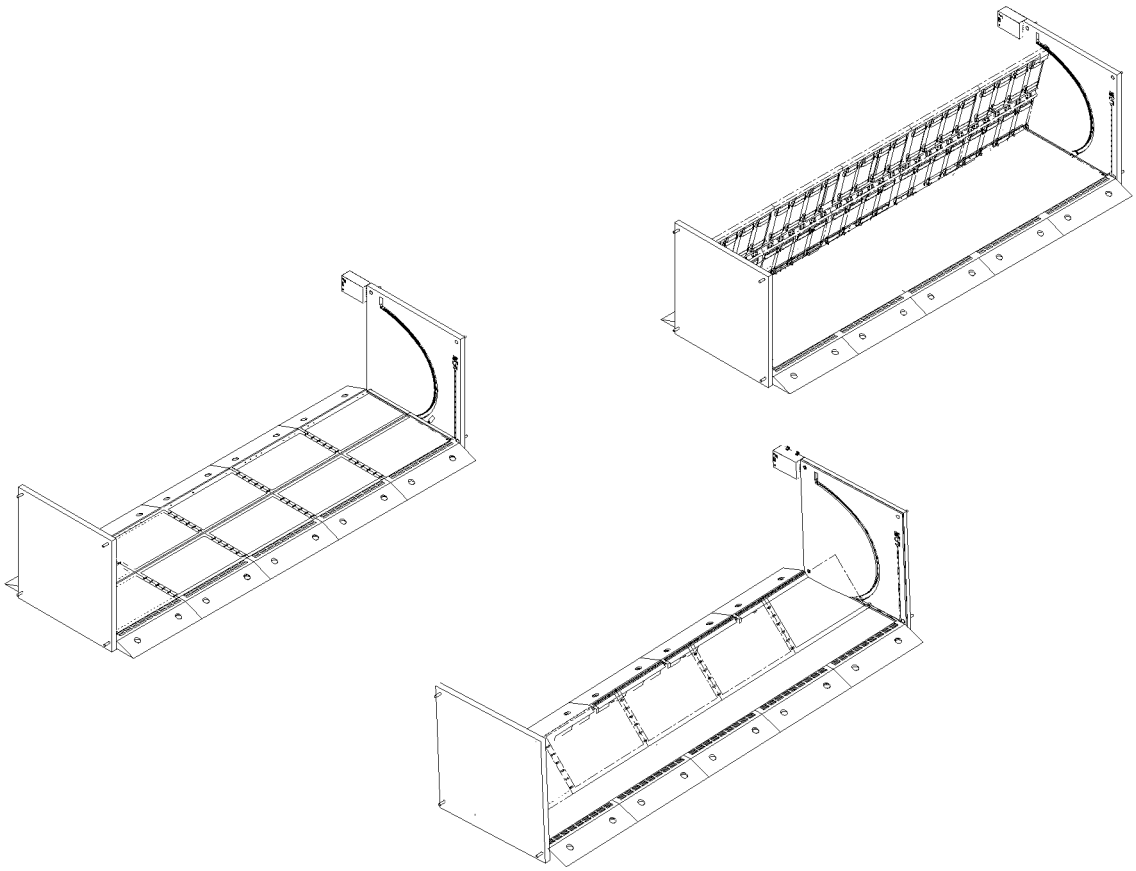
FIG. 20 is a schematic diagram of a workflow of Embodiment 2 of the present invention.

In the figures, I denotes a water blocking plate assembly, II denotes a driving mechanism, III denotes a base, IV denotes a side rail assembly, and V denotes a device control box;

I-01 denotes a piezoelectric patch, I-02 denotes a press strip, I-03 denotes a press strip spring, I-04 denotes a press strip fixing screw, I-05 denotes a piezoelectric patch padding plate, I-06 denotes a lower load bearing plate, I-07 denotes a polyurethane foamed layer, I-08 denotes an upper load bearing protection plate, I-09 denotes a hinge, I-10 denotes a piezoelectric patch fixing strip fixing screw, I-11 denotes waterproof rubber, I-12 denotes a connecting element, I-13 denotes a piezoelectric patch spring, I-14 denotes a water blocking plate rotating shaft hole, I-15 denotes a piezoelectric patch fixing strip, I-16 denotes a polyurethane foamed layer fixing sheet, I-17 denotes a polyurethane foamed layer fixing sheet screw, I-18 denotes a hole for a screw between load bearing plates, I-19 denotes a lower load bearing plate fixing screw, I-20 denotes a first connecting rod, and I-21 denotes a screw between load bearing plates;

II-01 denotes a rolling wheel, II-02 denotes a synchronous belt, II-03 denotes a step motor, II-04 denotes a transmission shaft end synchronous wheel, II-05 denotes a bearing, II-06 denotes a bearing hole, II-07 denotes a thick transmission shaft, II-08 denotes a belt wheel, II-09 denotes a motor shaft synchronous wheel, II-10 denotes a thin transmission shaft, and II-11 denotes a flat key;

III-01 denotes a base slope, III-02 denotes a base fixing screw bolt hole, III-03 denotes a water inlet hole, III-04 denotes a groove, III-05 denotes a reinforcing rib, III-06 denotes a support frame fixing end, and III-07 denotes a base rotating shaft hole;

IV-01 denotes a side plate, IV-02 denotes a liquid level sensor, IV-03 denotes a synchronous belt, IV-04 denotes an ascending rail, IV-05 denotes a position limiting switch, and IV-06 denotes an expansion screw bolt hole;

V-01 denotes a motor driver, V-02 denotes an energy storage battery, V-03 denotes a piezoelectric energy collecting chip, and V-04 denotes an emergency stop power-off switch.

DETAILED DESCRIPTION

It should be noted that, the following detailed descriptions are all exemplary, and are intended to provide further descriptions of this application. Unless otherwise specified, all technical and scientific terms used herein have the same meaning as commonly understood by a person of ordinary skill in the art to which this application belongs.

It should be noted that terms used herein are only for describing specific implementations and are not intended to limit exemplary implementations according to this application. As used herein, the singular form is intended to include the plural form, unless the context clearly indicates otherwise. In addition, it should further be understood that terms "comprise" and/or "include" used in this specification indicate that there are features, steps, operations, devices, components, and/or combinations thereof.

For convenience of description, the words "upper", "lower", "left" and "right", if exist in the present invention, only indicate upper, lower, left and right directions consistent with those of the accompanying drawings, are not intended to limit the structure, and are used only for ease of description of the present invention and brevity of description, rather than indicating or implying that the mentioned device or element needs to have a particular orientation or needs to be constructed and operated in a particular orientation. Therefore, such terms should not be construed as a limitation on the present invention.

As described in the related art, an existing underground garage water blocking mode has the defects of time waste and labor waste, and additionally, the access of vehicles is influenced at the early rainwater stage. By aiming at the above problems, the present application provides a hydrodynamic water blocking device for an underground garage.

In Embodiment 1 of a typical implementation of the present application, as shown in FIG. 1 to FIG. 16, the hydrodynamic water blocking device for an underground garage includes a base III. Side rail assemblies IV are disposed at two sides of the base, and are configured to be fixedly connected with a wall body. The base is connected with a water blocking plate assembly I. A device control box V is further included, and is configured to be fixed on the wall body.

The water blocking plate assembly includes a first water blocking element and a second water blocking element which are rotationally connected. A bottom end of the first water blocking element is rotationally connected with the base, and a top end is rotationally connected with a bottom end of the second water blocking element through a hinge I-09. A top end of the second water blocking element is provided with a driving mechanism II, the driving mechanism is connected with a walking assembly, and the walking assembly is embedded in an ascending rail of the side rail assembly. The ascending rail IV-04 includes a horizontally disposed linear rail and an arc-shaped lifting rail. The walking assembly moves in the linear rail, the first water blocking element and the second water blocking element can be driven to move to form a reverse V-shaped structure, and a water blocking effect is achieved.

The first water blocking element and the second water blocking element are of the same structure. Each of the first water blocking element and the second water blocking element includes an upper load bearing protection plate I-08, a cavity is formed in the upper load bearing protection plate, a lower load bearing plate I-06 is fixed in the cavity, a hole for a screw between load bearing plates I-18 is formed in each of four corners of the lower load bearing plate, and the lower load bearing plate is fixedly connected with a cavity wall of the cavity far away from the top surface of the upper load bearing protection plate through the holes for the screws between load bearing plates and lower load bearing plate fixing screws. Preferably, rubber is disposed between the lower load bearing plate and the upper load bearing protection plate.

A plurality of round holes are formed in an upper surface of the upper load bearing protection plate. Preferably, a diameter of the round hole is 30 mm. Those skilled in the art can set the diameter of the round hole according to practical requirements.

A power generating assembly is disposed in the cavity, is installed on the lower load bearing plate, and includes a plurality of press strips I-02. Preferably, the press strips are four. The two press strips are disposed in a middle position of the lower load bearing plate, one press strip is respectively disposed at each of two ends of the lower load bearing plate, and the middle position of each of the press strips is fixedly connected with the lower load bearing plate through a press strip fixing screw I-04.

The end portion of the press strip is fixedly connected with one end of a press strip elastic element, and the other end of the press strip elastic element is fixedly connected with the lower load bearing plate. Preferably, the press strip elastic element is a press strip spring I-03.

Through the press strips I-02, the press strip springs I-03 and the press strip fixing screws I-04, a certain extrusion distance exists between the upper load bearing protection plate I-08 and the lower load bearing plate I-06.

A plurality of piezoelectric patches I-01 are disposed in two long edge positions of the lower load bearing plate, one end of the piezoelectric patch is fixedly connected with the lower load bearing plate through a piezoelectric patch fixing strip I-15 and a piezoelectric patch fixing strip fixing screw I-10, a piezoelectric patch padding plate I-05 and a piezoelectric patch spring I-13 are disposed between each of the piezoelectric patches and the lower load bearing plate, one end of each of the piezoelectric patch springs is fixedly connected with the lower load bearing plate, and the other end is fixedly connected with the piezoelectric patch.

The piezoelectric patches are connected with an energy storage power supply in the device control box, preferably, the energy storage power supply is an energy storage battery V-02, and the energy storage battery is configured to supply electricity to other elements of the device.

In the present embodiment, when a vehicle goes into or out of a garage, the upper load bearing protection plate I-08 is extruded, at the same time, the press strip springs I-03 are compressed, the press strips I-02 deform, a distance between the upper load bearing protection plate I-08 and the lower load bearing plate I-06 is reduced, the piezoelectric patches I-01 and the piezoelectric patch springs I-13 are extruded to deform, and electric energy is generated.

A first stage water blocking plate rotating shaft hole I-14 is formed in one end of the first water blocking element, the first water blocking element is rotationally connected with the base through the first stage water blocking plate rotating shaft hole, a base rotating shaft hole III-07 formed in the base and a rotating shaft, and a rotating angle is 0° to 60°.

The other end of the first water blocking element is rotationally connected with the bottom end of the second water blocking element through a hinge I-09 and screws, and a rubber sealing strip is added to a hinge connecting position to prevent water leakage.

Foamed layers are disposed on the bottom surfaces of the upper load bearing protection plates of the first water blocking element and the second water blocking element, preferably, the foamed layers are polyurethane foamed layers, and the polyurethane foamed layers are connected through a polyurethane foamed layer fixing sheet I-16 and a polyurethane foamed layer fixing sheet screw I-17.

In the present embodiment, each of the first water blocking element and the second water blocking element consists of a plurality of water blocking unit modules. The adjacent water blocking unit modules are connected through connecting elements I-12, the connecting element is a connecting sheet, two fixing holes are formed in the connecting sheet, the connecting sheet is fixedly connected with the first water blocking element and the second water blocking element through screws, and additionally, a rubber sealing strip is added to a connecting position to reduce water leakage.

Preferably, waterproof rubber I-11 is respectively disposed at two side edges of the first water blocking element and the second water blocking element, and is configured to perform sealing among the first water blocking element, the second water blocking element and a side cabinet assembly to prevent water leakage.

The driving mechanism II is installed on the top end of the second water blocking element, and includes a driving element. Preferably, the driving element is a step motor II-03, the step motor is fixed to the top end of the second water blocking element, an output shaft of the step motor is connected with a transmission shaft through a transmission mechanism, the transmission shaft is connected with the walking assembly, the walking assembly is embedded in the ascending rail disposed in the side rail assembly, and can walk along the ascending rail under the effect of the driving mechanism.

The step motor is connected with the energy storage battery, and electric energy generated by the piezoelectric patches can be provided for the step motor through the energy storage battery.

The output shaft of the step motor is connected with a motor shaft synchronous wheel II-09, the motor shaft synchronous wheel is connected with a transmission shaft end synchronous wheel II-04 through a synchronous belt II-02, and the motor shaft synchronous wheel and the transmission shaft end synchronous wheel synchronously rotate. The motor shaft synchronous wheel, the transmission shaft end synchronous wheel and the synchronous belt jointly form the transmission mechanism. One end of a thick transmission shaft II-07 is connected with the transmission shaft end synchronous wheel, and the other end is connected with a thin transmission shaft II-10. The thin transmission shaft is connected with the walking assembly, and the thick transmission shaft and the thin transmission shaft jointly form a transmission shaft.

In the present embodiment, the thick transmission shaft and the thin transmission shaft only refer to that the diameter of the thick transmission shaft is greater than the diameter of the thin transmission shaft, and the sizes are not specifically limited.

The transmission shaft and two bearings II-05 are rotationally connected through bearing holes II-06, and the two bearings are fixed onto the upper load bearing protection plate of the second water blocking element through screws and are configured to support the transmission shaft.

The walking assembly includes a belt wheel II-08 and a rolling wheel II-01 which are sequentially fixed onto the transmission shaft, and the belt wheel and the rolling wheel are fixedly connected with the transmission shaft through a flat key II-11. The belt wheel and the rolling wheel are embedded in the ascending rail disposed in the side rail assembly.

Base slopes III-01 are disposed at the front and rear sides of the base, a base groove is formed in the upper surface of the base, a plurality of reinforcing ribs III-05 are disposed in the base groove, the base groove is separated into a plurality of grooves III-04 by the plurality of reinforcing ribs, and the width and the depth of the grooves are respectively identical to the width and the thickness of the polyurethane foamed layers. When the device is not used, the first water blocking element and the second water blocking element are unfolded to form 180°, and the foamed layers are embedded in the grooves, so that the vehicle can normally pass. The reinforcing ribs longitudinally pass through the base, the intensity of the base is improved, and the stability of the whole device is improved.

Water inlets III-03 are formed in the base slope, the water inlets communicate with a space inside the grooves through connecting passages, and rainwater flowing in through the water inlets can enter the grooves.

Preferably, the water inlets are rectangular openings, water enters the bottom of the foamed layers in the grooves through the water inlets, and buoyancy can be generated on the foamed layers.

Base fixing screw bolt holes III-02 are also formed in the base slope of the base, and the base is fixed on the ground through the base screw bolt fixing holes and screw bolts. Preferably, the screw bolts are expanded screw bolts, and the fixing intensity with the ground is high.

A support frame fixing end III-06 is disposed on the top surface of the reinforcing rib, the support frame fixing end is hinged to a bottom end of a second connecting rod, the top end of the second connecting rod is hinged to a hinging element, the hinging element is further hinged to a bottom end of a first connecting rod, and the top end of the first connecting rod is hinged to the bottom surface of the first water blocking element. Through the arrangement of the first connecting rod and the second connecting rod, the stability of the first water blocking element during rotation can be ensured.

The side rail assembly includes a side plate IV-01, an ascending rail IV-04 is disposed on the side plate, expanded screw bolt holes IV-06 are formed in the side plate, and the side plate can be fixedly connected with a wall body through the expanded screw bolt holes and expanded screw bolts.

In the present embodiment, the ascending rail includes a horizontally disposed linear rail and an arc-shaped lifting rail connected with the tail end of the linear rail, the linear rail is positioned at the bottom of the side plate, the walking assembly is embedded in the ascending rail, when the walking assembly walks along the linear rail, the first water blocking element and the second water blocking element can move to form a reverse V-shaped structure, and a water blocking effect is achieved on a low water level. A synchronous belt IV-03 is fixed on the lifting rail, when the walking assembly moves to the tail end of the linear rail to be in contact with the synchronous belt, the belt wheel can be in contact with the synchronous belt, the belt wheel rotates, the second water blocking element can be driven to be lifted along the lifting rail, and a water blocking effect is achieved on a high water level.

A position limiting switch IV-05 is disposed in a position above the linear rail. After the walking assembly touches the position limiting switch, a connecting line between the motor and the energy storage battery is conducted, and at the same time, a condition of wheel clamping of the rail caused by excessive lifting of the first water blocking element can also be prevented.

A liquid level sensor IV-02 is further installed on the side plate, and is configured to detect a liquid level height of rainwater.

The device control box portion V includes a motor driver V-01, an energy storage battery V-02, an energy collecting chip V-03 and an emergency stop power-off switch V-04.

Specifically, electric energy generated by the piezoelectric patches I-01 is stored into the energy storage battery V-02 by the energy collecting chip V-03 after being processed, the energy storage battery V-02 provides electric energy for the motor driver V-01 and the step motor II-03, additional connection with a power supply is not needed, and the use is convenient. The device is emergently powered off by an emergency stop power-off switch V-04 under emergency conditions, and the operation is stopped. The motor driver is connected with the step motor, and is configured to control the working of the step motor.

Embodiment 2

Figure 21:
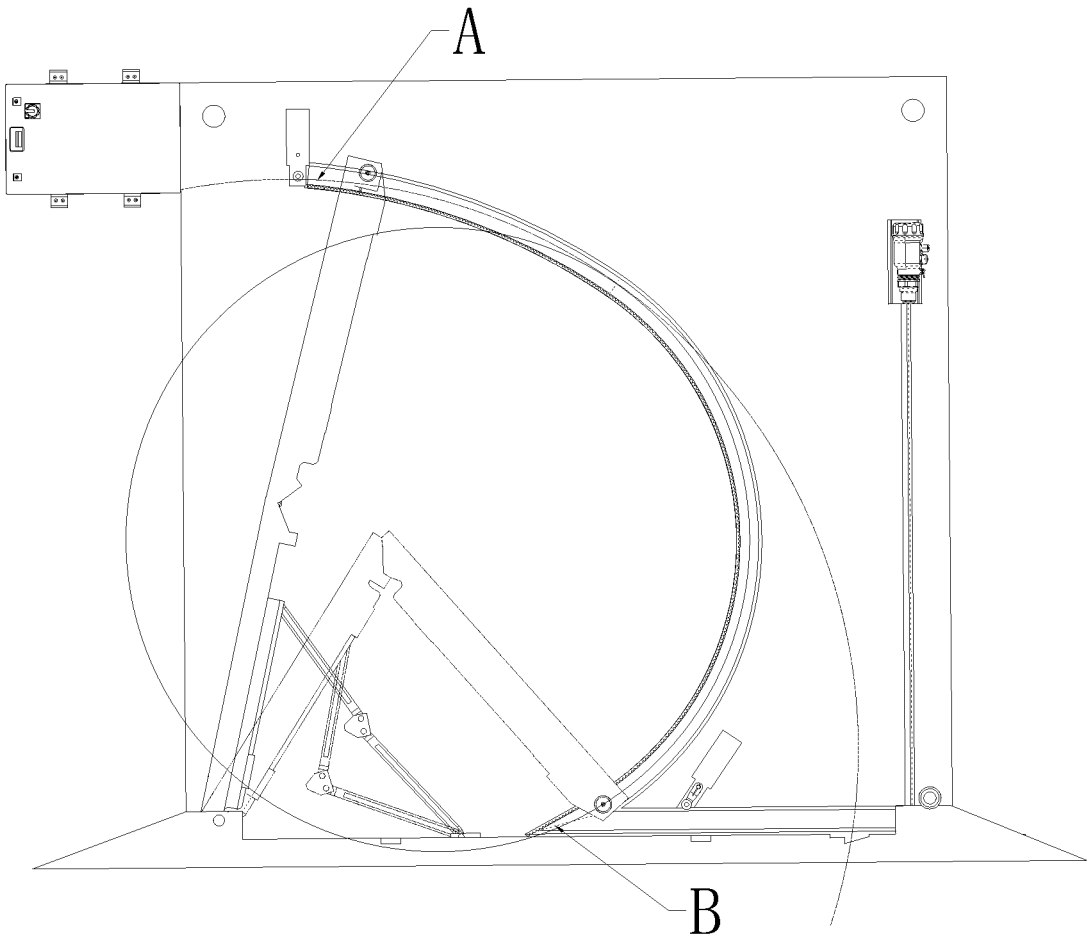
FIG. 21 is a side view of the workflow of Embodiment 2 of the present invention.
Figure 22:
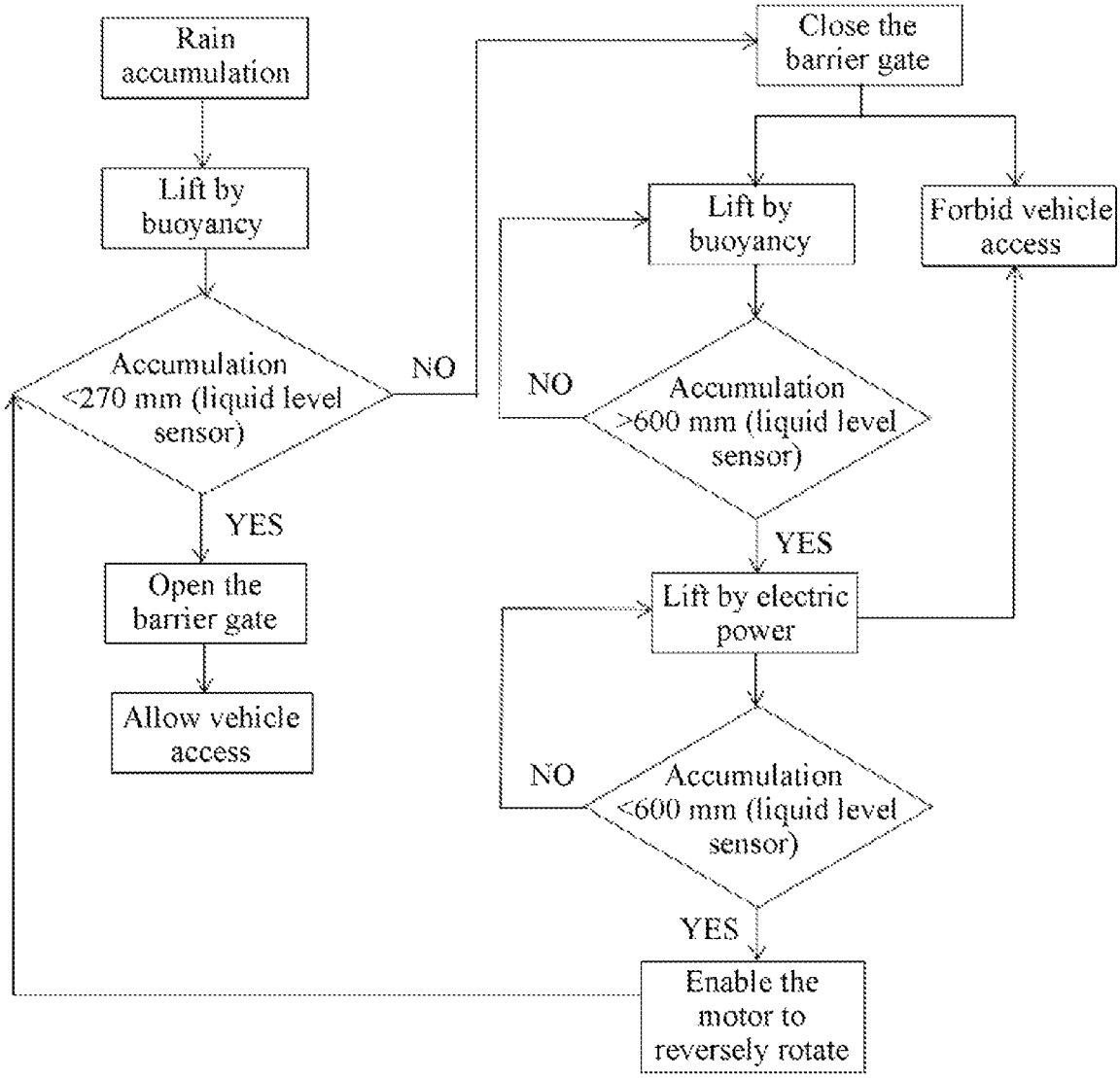
FIG. 22 is a schematic diagram of a workflow of Embodiment 1 of the present invention.

The present embodiment discloses a working method of the hydrodynamic water blocking device for an underground garage according to Embodiment 1, as shown in FIGS. 17-20, in a state of no rain, the first water blocking element and the second water blocking element are unfolded to form 180°, the polyurethane foamed layers are embedded inside the grooves of the base, and at this moment, the vehicle can normally pass; during raining, rainwater enters the grooves through the water inlets to generate buoyancy on the bottom of the polyurethane foamed layers, the first water blocking element and the second water blocking element are driven to move, the walking assembly moves along the linear rail, at this moment, the first water blocking element and the second water blocking element move to form a reverse V-shaped structure, and a rain blocking effect can be achieved when the water level is lower than 270 mm at the early rainwater stage. At the same time, the height of the highest point of the formed reverse V-shaped structure is smaller than the height of a vehicle chassis, at this moment, a barrier gate can be opened, and the normal passing of the vehicle cannot be influenced. When the walking assembly moves to the position limiting switch, the step motor is conducted with the energy storage battery. At this moment, the step motor is in a state of waiting for working. When the liquid level sensor detects that the water level is higher than a 270 mm alert water level, the barrier gate is closed, and the vehicle is not allowed to pass. When the liquid level sensor detects that the liquid level is higher than 600 mm, the liquid level sensor sends a signal to the motor driver, the motor driver controls the step motor to start to work, and the rolling wheel and the belt wheel are driven to rotate. In the linear rail, the rolling wheel moves along the linear rail, so that the height of the highest point of the reverse V-shaped structure rises. When the walking assembly moves to the tail end of the linear rail, the belt wheel is in contact with the synchronous belt, at this moment, under the effects of the synchronous belt and the belt wheel, the top end of the second water blocking element is lifted along the arc-shaped lifting rail until the top end of the second water blocking element moves to the tail end of the lifting rail. As shown in FIG. 21, the second water blocking element is lifted to a point A from an initial point B. At this moment, the water blocking height reaches the maximum. When the rain quantity is reduced, the step motor reversely rotates, and the top end of the second water blocking element descends.

When the water blocking device according to the present embodiment is used, automatic operation is achieved, sand bag stacking or water blocking plate nailing is not needed, the use is convenient, and the time and the labor are saved.

In the practical application process, the sizes of a plurality of components of the device are determined by use occasions. In the present embodiment, the horizontal area size of the first water blocking element is 580 mm*100 mm*5, and the horizontal area size of the second water blocking element is 630 mm*100 mm*5.

Firstly, in order to enable the dual-stage water blocking elements to operate through buoyancy, the size of polyurethane under the water blocking elements needs to be determined, and the buoyancy generated by the polyurethane foamed layers can be obtained through the following formula:

$$F[\text{buoyancy}]=\rho[\text{liquid}]gV[\text{discharge}]$$

In the formula, F[buoyancy] is maximum buoyancy capable of being generated by polyurethane foamed layers in single-stage water blocking plates, ρ[liquid] is a water density, g is a local acceleration of gravity, and is generally 10 $m/s^2$, the error is negligible, and V[discharge] is a maximum volume of the polyurethane foamed layers immersed in water. The size of polyurethane under the first-stage water blocking plate in the present embodiment is 460 mm*135 mm*30 mm.

The gravities of the upper load bearing protection layer, the lower load bearing layer and the polyurethane foamed layers per se shall be smaller than or equal to the maximum buoyancy capable of being generated by the polyurethane foamed layers in the single-stage water blocking plates. The mass of the energy storage battery and the piezoelectric patches between the upper load bearing protection layer and the lower load bearing layer is negligible.

$$F[\text{buoyancy}]=\rho[\text{polyurethane}]m[\text{polyurethane}]g+m_1g+m_2g \qquad \text{Stress analysis}$$

In the formula, $m_1$ is the mass of the upper load bearing protection layer, $m_2$ is the mass of the lower load bearing layer, and F is the maximum buoyancy capable of being generated by the polyurethane foamed layers in the single-stage water blocking plates. Materials of the upper load bearing protection plate and the lower load bearing plate are aluminum alloy, and aluminum alloy densities are different when different alloy elements are added, and are generally 2.5-2.88. The aluminum alloy density is 2.5 $g/cm^3$ in the present embodiment.

By taking the first-stage water blocking plate as an example, through calculation analysis, the total volume of the upper load bearing protection plate and the lower load bearing plate of the water blocking plate with the density of 2.5 $g/cm^3$ can be 5.10 mm, the load bearing protection requirement can be met, and a volume calculation method of the load bearing layer of the second water blocking element is the same as that of the first water blocking element.

The specific implementations of the present invention are described above with reference to the accompanying drawings, but are not intended to limit the protection scope of the present invention. Those skilled in the art should understand that various modifications or deformations may be made without creative efforts based on the technical solutions of the present invention, and such modifications or deformations shall fall within the protection scope of the present invention.

What is claimed is:

1. A hydrodynamic water blocking device for an underground garage, comprising a water blocking plate assembly and side rail assemblies, wherein the water blocking plate assembly comprises a first water blocking element, one end of the first water blocking element is rotationally connected with a base, an opposite end of the first water blocking element is rotationally connected with one end of a second water blocking element, the first water blocking element and the second water blocking element are provided with foamed layers, the base is provided with grooves capable of accommodating the embedded foamed layers, water inlets formed in the base communicate with the grooves, each of the side rail assemblies comprises a side plate, the side plate is provided with an ascending rail, the ascending rail comprises a horizontally disposed linear rail and an arc-shaped lifting rail, the second water blocking element is provided with a walking assembly embedded in the ascending rail, and the walking assembly is connected with a driving mechanism installed at the second water blocking element.

2. The hydrodynamic water blocking device for an underground garage according to claim 1, wherein each of the first water blocking element and the second water blocking element is provided with a power generating assembly mounted thereon, the power generating assembly is connected with an energy storage power supply, and the energy storage power supply is connected with the driving mechanism, and is configured to supply electricity to the driving mechanism.

3. A working method of the hydrodynamic water blocking device for an underground garage according to claim 2, wherein the grooves formed in the base receive rainwater flowing in from the water inlets, buoyancy is generated on the first water blocking element and the second water blocking element through the foamed layers, the rolling wheel moves along the linear rail, the top end of the first water blocking element and the bottom end of the second water blocking element are lifted to achieve a water blocking effect, after the water level reaches a set alert height, the driving mechanism drives the walking assembly to work, the walking assembly enters the lifting rail through the linear rail and then ascends along the lifting rail, and the top end of the second water blocking element is lifted.

4. The hydrodynamic water blocking device for an underground garage according to claim 2, wherein each of the first water blocking element and the second water blocking element comprises an upper load bearing protection plate with a cavity formed at the inside, a lower load bearing plate is fixed inside the upper load bearing protection plate, the power generating assembly comprises press strips, a middle portion of the press strip is fixed to the lower load bearing plate, an end portion presses the upper load bearing protection plate through a press strip elastic element, the lower load bearing plate is further fixedly connected with one end of a plurality of piezoelectric patches, an opposite end of the piezoelectric patches is connected with the lower load bearing plate through piezoelectric patch elastic elements, and a piezoelectric patch padding plate is disposed between the piezoelectric patches and the lower load bearing plate.

5. A working method of the hydrodynamic water blocking device for an underground garage according to claim 4, wherein the grooves formed in the base receive rainwater flowing in from the water inlets, buoyancy is generated on the first water blocking element and the second water blocking element through the foamed layers, the rolling wheel moves along the linear rail, the top end of the first water blocking element and the bottom end of the second water blocking element are lifted to achieve a water blocking effect, after the water level reaches a set alert height, the driving mechanism drives the walking assembly to work, the walking assembly enters the lifting rail through the linear rail and then ascends along the lifting rail, and the top end of the second water blocking element is lifted.

6. The hydrodynamic water blocking device for an underground garage according to claim 1, wherein the foamed layers are polyurethane foamed layers, and the polyurethane foamed layers are fixed onto bottom surfaces of the first water blocking element and the second water blocking element through polyurethane foamed layer fixing sheets.

7. A working method of the hydrodynamic water blocking device for an underground garage according to claim 6, wherein the grooves formed in the base receive rainwater flowing in from the water inlets, buoyancy is generated on the first water blocking element and the second water blocking element through the foamed layers, the rolling wheel moves along the linear rail, the top end of the first water blocking element and the bottom end of the second water blocking element are lifted to achieve a water blocking effect, after the water level reaches a set alert height, the driving mechanism drives the walking assembly to work, the walking assembly enters the lifting rail through the linear rail and then ascends along the lifting rail, and the top end of the second water blocking element is lifted.

8. The hydrodynamic water blocking device for an underground garage according to claim 1, wherein each of the first water blocking element and the second water blocking element comprises a plurality of water blocking unit modules, and the adjacent water blocking unit modules are connected through connecting elements.

9. A working method of the hydrodynamic water blocking device for an underground garage according to claim 8, wherein the grooves formed in the base receive rainwater flowing in from the water inlets, buoyancy is generated on the first water blocking element and the second water blocking element through the foamed layers, the rolling wheel moves along the linear rail, the top end of the first water blocking element and the bottom end of the second water blocking element are lifted to achieve a water blocking effect, after the water level reaches a set alert height, the driving mechanism drives the walking assembly to work, the walking assembly enters the lifting rail through the linear rail and then ascends along the lifting rail, and the top end of the second water blocking element is lifted.

10. The hydrodynamic water blocking device for an underground garage according to claim 1, wherein the first water blocking element is hinged to one end of a first connecting rod, an opposite end of the first connecting rod is hinged to a hinging element, the hinging element is hinged to one end of a second connecting rod, and an opposite end of the second connecting rod is hinged to the base.

11. A working method of the hydrodynamic water blocking device for an underground garage according to claim 10, wherein the grooves formed in the base receive rainwater flowing in from the water inlets, buoyancy is generated on the first water blocking element and the second water blocking element through the foamed layers, the rolling wheel moves along the linear rail, the top end of the first water blocking element and the bottom end of the second water blocking element are lifted to achieve a water blocking effect, after the water level reaches a set alert height, the driving mechanism drives the walking assembly to work, the walking assembly enters the lifting rail through the linear rail and then ascends along the lifting rail, and the top end of the second water blocking element is lifted.

12. The hydrodynamic water blocking device for an underground garage according to claim 1, wherein the driving mechanism comprises a driving element fixed to a top end of the second water blocking element, the driving element is connected with a transmission shaft through a transmission mechanism, the transmission shaft is connected with the walking assembly, the walking assembly comprises a belt wheel and a rolling wheel, the rolling wheel and the belt wheel are embedded in the ascending rail, and the belt wheel is able to be in contact with a synchronous belt disposed in the lifting rail.

13. The hydrodynamic water blocking device for an underground garage according to claim 12, wherein a liquid level sensor is disposed on the side plate, and is configured to detect a water level height of rainwater.

14. A working method of the hydrodynamic water blocking device for an underground garage according to claim 13, wherein the grooves formed in the base receive rainwater flowing in from the water inlets, buoyancy is generated on the first water blocking element and the second water blocking element through the foamed layers, the rolling wheel moves along the linear rail, the top end of the first water blocking element and the bottom end of the second water blocking element are lifted to achieve a water blocking effect, after the water level reaches a set alert height, the driving mechanism drives the walking assembly to work, the walking assembly enters the lifting rail through the linear rail and then ascends along the lifting rail, and the top end of the second water blocking element is lifted.

15. A working method of the hydrodynamic water blocking device for an underground garage according to claim 12, wherein the grooves formed in the base receive rainwater flowing in from the water inlets, buoyancy is generated on the first water blocking element and the second water blocking element through the foamed layers, the rolling wheel moves along the linear rail, the top end of the first water blocking element and the bottom end of the second water blocking element are lifted to achieve a water blocking effect, after the water level reaches a set alert height, the driving mechanism drives the walking assembly to work, the walking assembly enters the lifting rail through the linear rail and then ascends along the lifting rail, and the top end of the second water blocking element is lifted.

16. The hydrodynamic water blocking device for an underground garage according to claim 1, wherein a position limiting switch is disposed at one side of the linear rail, and the position limiting switch is able to be in contact with the walking assembly.

17. A working method of the hydrodynamic water blocking device for an underground garage according to claim 16, wherein the grooves formed in the base receive rainwater flowing in from the water inlets, buoyancy is generated on the first water blocking element and the second water blocking element through the foamed layers, the rolling wheel moves along the linear rail, the top end of the first water blocking element and the bottom end of the second water blocking element are lifted to achieve a water blocking effect, after the water level reaches a set alert height, the driving mechanism drives the walking assembly to work, the walking assembly enters the lifting rail through the linear rail and then ascends along the lifting rail, and the top end of the second water blocking element is lifted.

18. A working method of the hydrodynamic water blocking device for an underground garage according to claim 1, wherein the grooves formed in the base receive rainwater flowing in from the water inlets, buoyancy is generated on the first water blocking element and the second water blocking element through the foamed layers, the rolling wheel moves along the linear rail, the top end of the first water blocking element and the bottom end of the second water blocking element are lifted to achieve a water blocking effect, after the water level reaches a set alert height, the driving mechanism drives the walking assembly to work, the walking assembly enters the lifting rail through the linear rail and then ascends along the lifting rail, and the top end of the second water blocking element is lifted.

* * * * *